US007454932B2

(12) United States Patent
Hollier

(10) Patent No.: US 7,454,932 B2
(45) Date of Patent: Nov. 25, 2008

(54) LOCKABLE TIE DOWN

(75) Inventor: Clinton Hollier, Coorparoo (AU)

(73) Assignee: CMH Products Pty Ltd, Queensland (AU)

( * ) Notice: Subject to any disclaimer, the term of this patent is extended or adjusted under 35 U.S.C. 154(b) by 0 days.

(21) Appl. No.: 11/628,584

(22) PCT Filed: Jun. 2, 2005

(86) PCT No.: PCT/AU2005/000786

§ 371 (c)(1),
(2), (4) Date: Dec. 4, 2006

(87) PCT Pub. No.: WO2005/118990

PCT Pub. Date: Dec. 15, 2005

(65) Prior Publication Data

US 2007/0251279 A1 Nov. 1, 2007

(30) Foreign Application Priority Data

Jun. 3, 2004 (AU) ..... 2004902937

(51) Int. Cl.
*E05B 73/00* (2006.01)

(52) U.S. Cl. ..... 70/18; 70/19; 24/170

(58) Field of Classification Search ..... 70/14, 70/18, 19, 30, 49, 55, 57, 58, 164; 24/170, 24/191, 194, 193
See application file for complete search history.

(56) References Cited

U.S. PATENT DOCUMENTS

| | | | | | |
|---|---|---|---|---|---|
| 2,981,993 | A | * | 5/1961 | Elsner | 24/170 |
| 3,020,612 | A | * | 2/1962 | Meeker | 24/170 |
| 3,413,691 | A | * | 12/1968 | Elsner | 24/170 |
| 3,872,550 | A | * | 3/1975 | Yang | 24/170 |
| 3,875,771 | A | | 4/1975 | Reisner | |
| 4,136,422 | A | * | 1/1979 | Ivanov et al. | 24/170 |
| 4,233,713 | A | * | 11/1980 | Berg | 24/191 |
| 4,373,234 | A | | 2/1983 | Boden | |
| 4,685,315 | A | | 8/1987 | Comolli | |
| 4,727,628 | A | * | 3/1988 | Rudholm | 24/170 |
| 5,005,527 | A | * | 4/1991 | Hatfield | 119/793 |
| 5,074,011 | A | * | 12/1991 | Carlson | 24/170 |
| 5,119,649 | A | | 6/1992 | Spence | |
| 5,127,861 | A | | 7/1992 | Ross | |
| 5,172,455 | A | * | 12/1992 | Johnson et al. | 24/170 |
| 5,572,771 | A | * | 11/1996 | Kelleghan | 24/170 |
| 5,582,046 | A | * | 12/1996 | Baumwoll et al. | 70/237 |

(Continued)

FOREIGN PATENT DOCUMENTS

NL 1017968 11/2002

*Primary Examiner*—Suzanne D Barrett
(74) *Attorney, Agent, or Firm*—D. Peter Hochberg; Sean F. Mellino; Daniel J. Smola

(57) ABSTRACT

A lockable tie down strap comprises a strap member having one end captively connected to a buckle member and a free end engageable over a load bearing member in the buckle body to enable the strap member to be tensioned. A lockable latch member is pivotally mounted in the body and includes a first jaw surface adapted to clampingly engage the strap member against a second jaw surface associated with body. The strap member includes a pair of steel reinforcing cords located in respective pockets extending longitudinally of the strap member adjacent opposed edges thereof.

16 Claims, 5 Drawing Sheets

U.S. PATENT DOCUMENTS 5,920,963 A * 7/1999 Chou ..... 24/170
6,003,348 A 12/1999 McCrea
6,163,935 A 12/2000 Hinkey
6,199,412 B1 3/2001 Kennedy
6,327,752 B1 12/2001 Hinkey
6,381,810 B2 * 5/2002 Hsieh ..... 24/170
6,510,717 B1 1/2003 Levi
6,526,629 B1 * 3/2003 Warner et al. ..... 24/71 R
6,665,913 B2 * 12/2003 Kosh et al. ..... 24/193
6,715,449 B1 * 4/2004 Jordan ..... 119/863
6,769,157 B1 * 8/2004 Meal ..... 24/633
D496,881 S * 10/2004 Pontaoe ..... D11/216
6,868,587 B2 * 3/2005 Rard ..... 24/170
6,993,942 B2 * 2/2006 Boni et al. ..... 70/18
7,121,122 B2 * 10/2006 Levi ..... 70/18
2003/0019080 A1 * 1/2003 Anthony et al. ..... 24/68 R
2004/0187271 A1 * 9/2004 Mikkelsen ..... 24/170
2005/0020154 A1 1/2005 Millist

* cited by examiner

LOCKABLE TIE DOWN

CROSS-REFERENCE TO RELATED APPLICATION

This application is a National Stage application of International Application No. PCT/AU2005/000786, filed on Jun. 2, 2005, which claims priority of Australian Provisional application number 2004902937, filed on Jun. 3, 2004.

BACKGROUND OF THE INVENTION

1. Field of the Invention

This invention is concerned with lockable tie down straps. The invention is concerned particularly although not exclusively with lockable tie down straps to secure sporting equipment such as surfboards, snow boards or the like to vehicle roof racks or similar support structures.

2. Description of the Prior Art

Valuable sporting articles such as surfboards, snow boards, sail boards, kayaks, canoes and the like are usually transported on a vehicle roof rack or a support structure such as sports bars associated with a pick-up truck. Often these sporting articles are left unattended for considerable periods of time leaving the surfboards, snow boards, sail boards, kayaks, canoes or the like vulnerable to theft.

Over the years many anti-theft securing devices have been proposed.

One such device is disclosed in U.S. Pat. No. 6,003,348 relating to a surfboard cable lock having a fixed loop swaged at one end of the cable and a releasable loop at the other end secured to a body member by means of a padlock or the like. While the cable is lockable around the body of the surfboard adjacent the fin or fins to prevent theft of the surfboard, separate tie down straps are required to secure the surfboard to a vehicle roof rack or the like. Where the board has removable fins, this locking system is ineffective.

U.S. Pat. Nos. 5,119,649 and 5127861 and U.S. patent application Ser. No. 10/495,178 all describe locking mechanisms for surfboards which require the formation of through holes through the body of the surfboard or the incorporation into the body of the surfboard of a specially shaped socket member adapted to receive a complementary shaped spigot on the end of a cable to secure the surfboard to a vehicular roof rack. As most surfboards are not manufactured with these fittings they must be retrofitted which is expensive and disfiguring to the surfboard and can comprise the structural integrity thereof. Like the locking cable of U.S. Pat. No. 6,003,348, separate tie down straps are required which adds to both expense and increases the inconvenience of use.

U.S. Pat. Nos. 3,875,771 and 4685315 describe luggage strap locks for suitcases and the like. U.S. Pat. No. 3,875,771 describes an arrangement wherein a free end of the flexible fabric strap is passed through a hollow lock body from one end to the other and is secured therein by a resiliently biased toothed cam which is held in a locked position by tension on the strap. The strap is releasable from the lock by a key which disengages the toothed cam from the strap. U.S. Pat. No. 4,685,315 describes a lockable luggage strap which has a lever actuated cam member located within a hollow housing with a lockable cover to retain the cam lever in a locked position and otherwise prevent access thereto.

Neither of U.S. Pat. Nos. 3,875,771 or 4,685,315 would be suitable as a lockable tie down for surfboards or the like due to the difficulty of threading the free end of the strap through the locked body in an overhead position on a vehicular roof rack. Moreover, as both describe a simple fabric strap prone to stretching under prolonged tension during travel these straps would loosen sufficiently to allow a surfboard to be slid out from under the straps. Yet further disadvantages with these luggage straps is that they are easily cut with a knife and the strap engaging mechanisms would damage the straps leading to early failure.

U.S. Pat. Nos. 6,163,935 and 6327752 respectively describe tensionable locking clamps for tie down cables and tie down cords or straps. In both cases a free end of a cable, cord or strap has fixedly secured thereon a transverse retaining post engageable in spaced slotted apertures on the inner side of a hinged lid of a lockable hollow body to prevent disengagement of the retaining post. A plurality of spaced slotted apertures are provided to enable the hinged lid to function as a tensioning lever. The other end of the cable or cord is captively retained in the hollow body by a wedge mechanism which allows the length of the cable or cord to be adjusted when the hollow body is not under tension. The use of thin cables or cords is not recommended where a surfboard is to be secured to a roof rack by tensioning the cable or cord to achieve the required degree of frictional engagement as the point load applied by the narrow cord or cable can easily damage the surfboard.

A strap lock described in U.S. Pat. No. 6,510,717 is designed to secure a bicycle or the like to a bicycle rack or post-like structure such as a signpost or the like. The strap is reinforced to resist cutting and a cam locking device for the strap is located within a tamperproof hollow body secured by a lockable lid. The strap enters a slot at one end of the body, passes under the cam locking device and exits via another slot at the other end of the body. By passing straight through the body the strap cannot be tensioned efficiently by hand and as the cam lock is formed integrally with the hinged cover for the body, it actually loosens the strap as the cover is moved to the closed position. As with the luggage straps of U.S. Pat. Nos. 3,875,771 and 4,685,315, this device would be difficult to use in an overhead position in securing a surfboard to a roof rack.

U.S. Pat. No. 6,199,412 describes a lockable tie down strap for a variety of loads to be secured to a vehicle roof rack or the like. The device includes a steel reinforced strap to resist being cut with a knife but has an exposed captive end which is easily disengaged by cutting stitching between the strap and a free end thereof folded back upon itself after passing over a transverse retaining bar in a strap retaining mechanism. The strap retaining mechanism comprises a base, upright side members and a latch member forming a hollow housing locating the operative tongue portion of a lock mounted on the latch member. The tongue portion of the lock is accessible by a screwdriver or the like via an aperture in the rear of the body of the strap retaining mechanism. A further disadvantage is that a toothed self-locking jaw is located remotely from a pivotal mounting of the latch whereby release of the locking jaw is difficult and causes frictional wear on the strap when the toothed jaw is disengaged tangentially along a surface of the strap extending around a retaining pin.

While each of the aforementioned lockable securing devices is generally satisfactory for a respective intended purpose, none provide a simple yet elegant solution to the problem of easily and safely securing surfboards, snow boards and the like to vehicular supporting racks or frames.

It is an aim of the present invention to provide a lockable tie down strap for surfboards, snow boards and the like wherein at least some of the disadvantages of prior art securing devices are overcome or ameliorated.

SUMMARY OF THE INVENTION

According to one aspect of the invention there is provided a tensionable lockable tie down strap for securing a surfboard to a vehicle carry rack, said strap comprising:

at least one flexible strap member including at least one reinforcing element;

a buckle member comprising a body adapted to fixedly secure a captive end of said at least one flexible strap member inaccessibly within said body;

a latch member adapted to releasably engage a free end portion of said strap member, said latch member being movable between a strap release position and a strap securing position;

a lock mechanism to selectively secure said latch member in said strap securing position, said lock member being located in an inaccessible enclosure in said buckle member; and, opposed jaw surfaces comprising a first jaw surface associated with said body and a second jaw surface associated with said latch member, said free end portion of said flexible strap member extending back around a load bearing member associated with said buckle to permit, in use, a mechanical advantage when a tensile force is applied to said free end portion of said strap member.

Suitably, said flexible strap member is substantially inextensible.

Preferably, said jaw surfaces, in use, are adapted to apply a substantially even compressive force across the width of said at least one flexible strap member secured therebetween.

If required, said opposed jaw surfaces may be contoured to accommodate transverse variations in thickness in said strap member.

The flexible strap member may include a plurality of reinforcing elements.

Preferably, said flexible strap member includes reinforcing elements located adjacent opposite edges thereof.

The opposed jaw surfaces may be self clamping when said flexible strap member is tensioned.

If required, at least one of said opposed jaw surfaces may include toothed projections.

Suitably, at least one of said opposed jaw members includes at least one smooth surface.

The body may include a shroud member restricting access to one end of a flexible strap member captively secured within said body.

The shroud member may be removable from said body when said free end portion of said flexible strap member is disconnected from said body.

If required, said shroud member may form a protective cover extending over a base of said body.

Suitably, said latch member is pivotally mounted to said body.

Preferably, a pivotal axis of said latch member is located adjacent a jaw surface formed thereon to provide, in use, a mechanical advantage to disengage said jaw surfaces when in a self-clamping state.

Suitably, said lock mechanism is mounted in said latch member.

Preferably, said first jaw surface is formed on said load bearing member.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

BRIEF DESCRIPTION OF THE DRAWINGS

In order that the invention may be easily understood and put into practical effect, reference will now be made to exemplary embodiments of the invention as illustrated in the accompanying drawings in which.

In the drawings like reference numerals are employed for like features for the sake of simplicity.

DETAILED DESCRIPTION OF THE PREFERRED EMBODIMENTS

Figure 1:
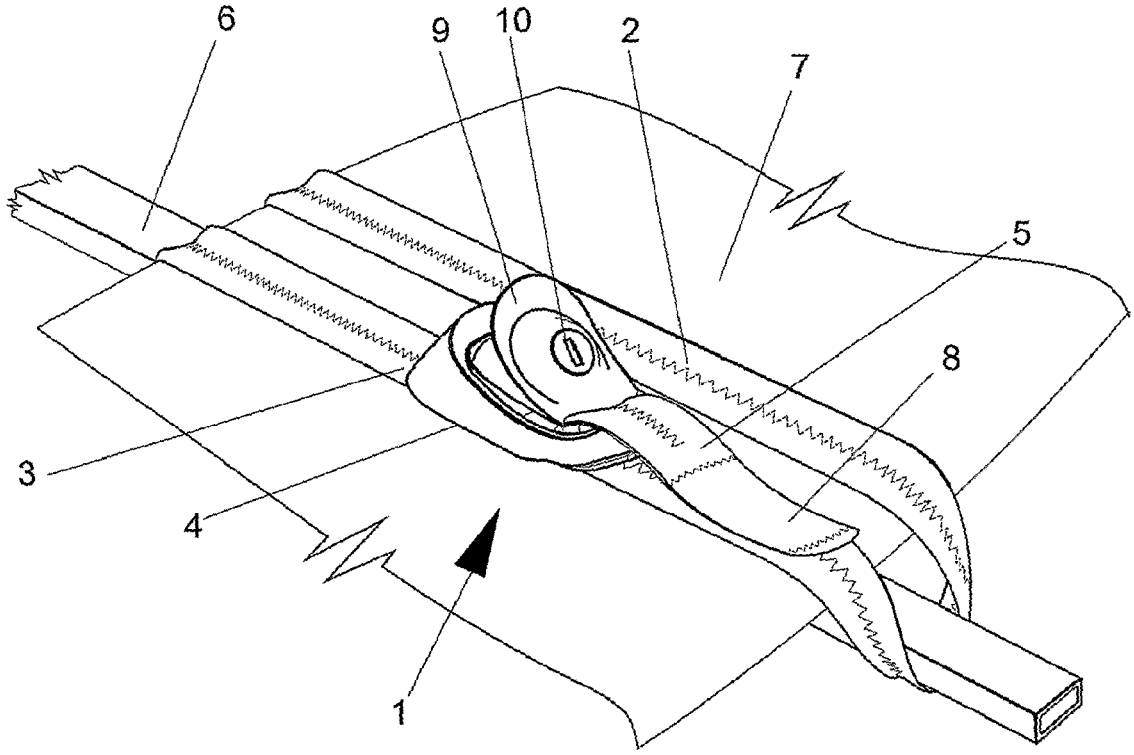
FIG. 1 shows schematically portion of a surfboard secured to a cross-bar of a vehicle roof rack.

FIG. 1 shows schematically the attachment of a surfboard to a cross-bar of a vehicular roof rack.

In the drawing, the tie down strap 1 comprises a flexible reinforced strap member 2 having one end 3 thereof captively secured in a buckle member 4 and a free end portion 5 of strap member 2 releasably secured within buckle member 4. Flexible strap member 2 is a single strap which loops under cross-bar 6 on each side of a surfboard 7.

In use, the strap member 2 is looped around cross-bar 6 and over the surfboard 7 as shown and is secured by pulling on the free end 8 of strap 2 to tension the strap such that the frictional engagement between the strap 2 and the surfboard 7 and also between surfboard 7 and cross-bar 6 is such that the surfboard cannot be disengaged by sliding the surfboard along its longitudinal axis. When tensioned, strap 2 is secured in buckle 4 by a latch member 9 having a key actuated lock 10 therein.

Figure 2:
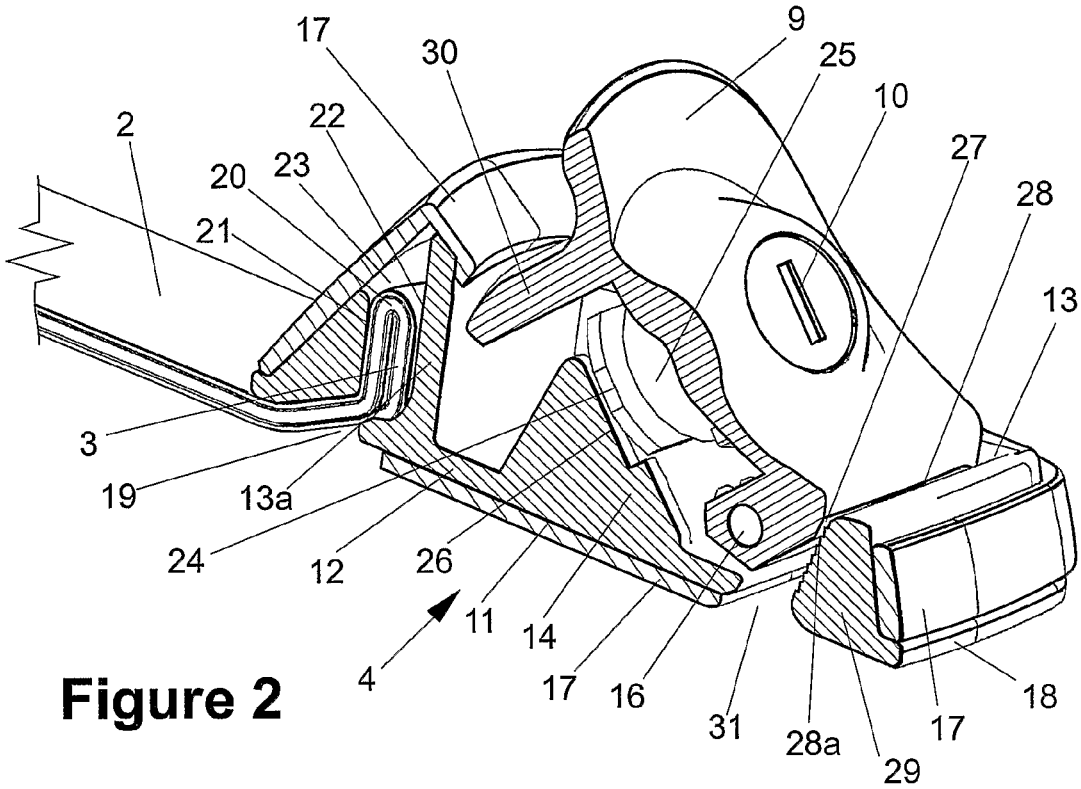
FIG. 2 shows a sectioned view of a lockable latch mechanism in a locked position.

FIG. 2 shows a part cross-sectional view of the buckle 4 in FIG. 1.

As illustrated, buckle 4 comprises a body 11 comprising a base 12, a rear wall 13*a* formed on a side wall 13 extending between rear wall 13*a* and a front portion 29. Formed on an inner face of base 12 is an upwardly extending projection 14 and a latch member 9 is pivotally mounted between side walls 13 on a pin 16. A semi-flexible plastics shroud 17 extends around and over a top edge of rear wall 13*a* over side walls 13, beneath base 12 and around the front end 18 of body 11. Shroud 17 forms a tamperproof cover for one end 3 of a strap member 2 captively located in a slotted aperture 19 formed in the base 12 behind rear wall 13*a*. Captive end 3 of strap 2 is inserted through slotted aperture 19 in base 12 in the absence of shroud 17 and is bent back upon itself to form a loop 20 of strap 2 of double thickness. An unlooped free end of strap 2 is then pulled downwardly to wedgingly engage looped portion 20 between the downwardly converging tapered side walls 21, 22 of retaining slot 23.

As illustrated, latch member 9 is locked in a clamped position with a lock tongue 24 pivotally mounted to lock cylinder 25 and, in the clamped position shown, in abutting engagement with a shouldered abutment 26 formed in projection 14. In the locked position shown, latch member 9 is unable to pivot rearwardly to move a second jaw surface 27 on latch member 9 away from a first jaw surface 28 on a front portion 29 on body 11. A lock surrounding guard wall 30 depends from an undersurface of latch member 9 to prevent access to the lock cylinder 25 and lock tongue 24 when the buckle 4 is in a locked state. A slotted aperture 31 is formed in base 12 adjacent the front portion 29 of body 11. If required, an inner surface of front portion 29 may have toothed projections 28*a* formed on jaw surface 28.

Figure 3:
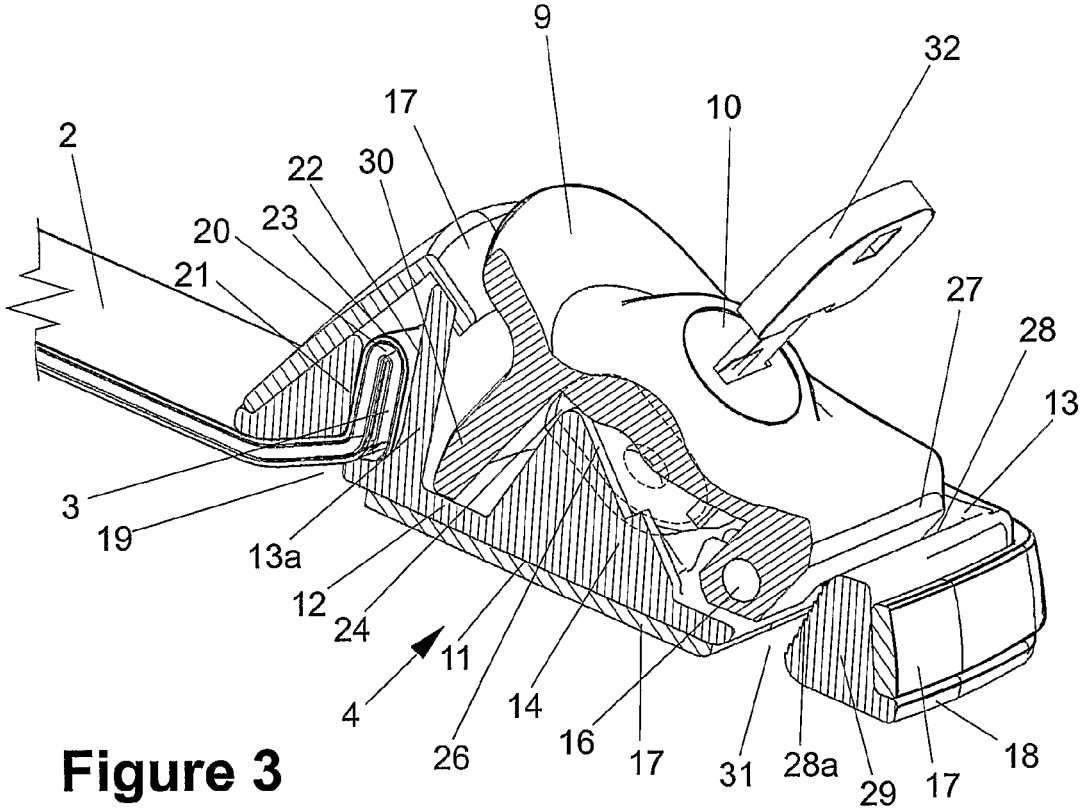
FIG. 3 shows a sectioned view of the latch mechanism of FIG. 2 in an unlocked position.

FIG. 3 shows the arrangement of FIG. 2 in an unlocked state wherein lock tongue 24 is rotated out of engagement with shouldered abutment 26 by a key 32 to enable the rear portion of latch member 9 to move downwardly by pivoting about pin 16 to open jaw surfaces 27,28.

Figure 4:
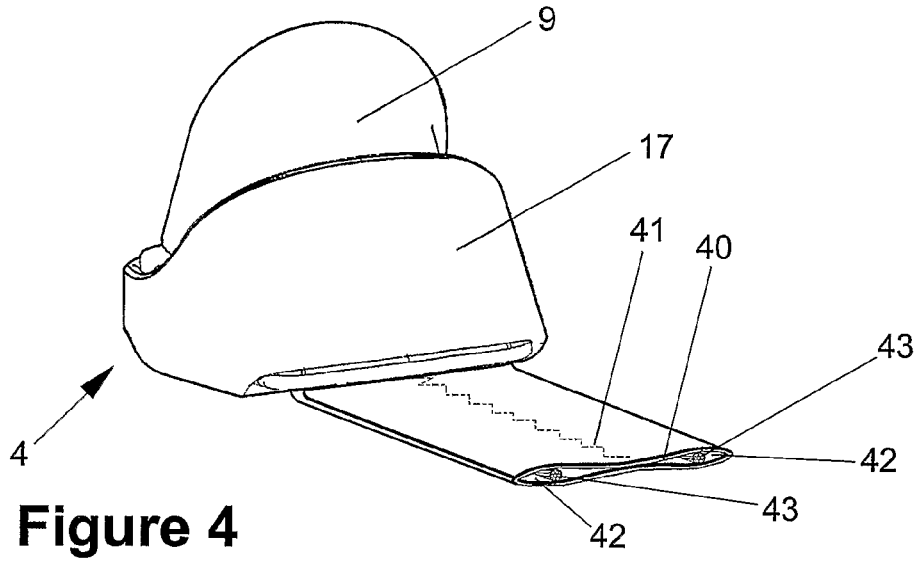
FIG. 4 shows a partial rear view of the lockable latch mechanism.

FIG. 4 shows a rear view of the buckle/strap assembly shown in FIGS. 2 and 3.

In FIG. 4, strap member 2 is formed with a fabric sheath 40 which is stitched down the central region 41 to form longitudinally extending pockets 42, each locating a flexible, multicore stainless steel cable 43 capable of resisting cutting of the strap member 2 and theft of an article being tied down therewith.

Figure 5:
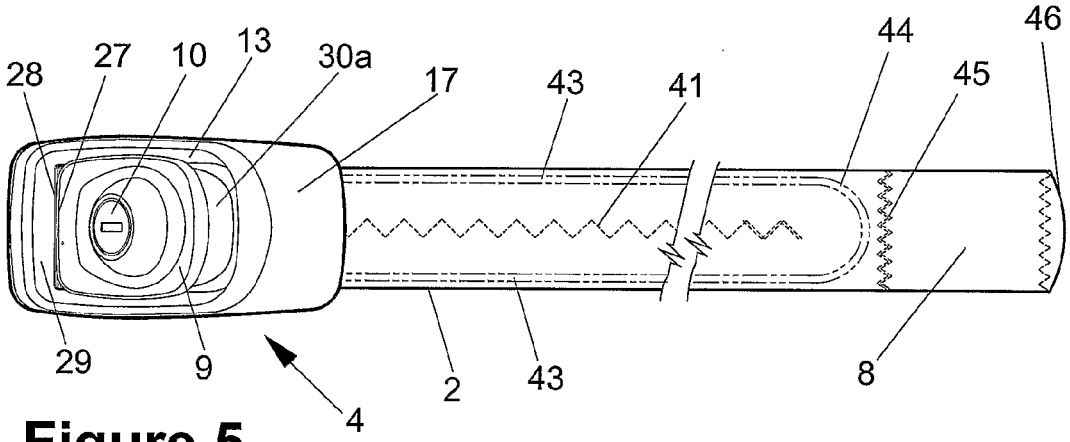
FIG. 5 shows a top plan view of a lockable tie down strap according to the invention.

FIG. 5 shows a top plan view of a lockable tie down strap according to the invention showing the juxtaposition of side walls 13 and a rear portion 30*a* of a lock surrounding wall 30 formed over the undersurface of latch member 9.

A lockable buckle member 4 has one end of a steel cable reinforced flexible strap secured therein. Steel cable 43 forms a loop 44 adjacent a free end 8 of strap member 2 and is secured by cross-stitching 45 to form an unreinforced free end portion 8. At the extremity of free end 8 the fabric of strap member 2 is prevented from fraying by a heat sealed region 46.

Figure 6:
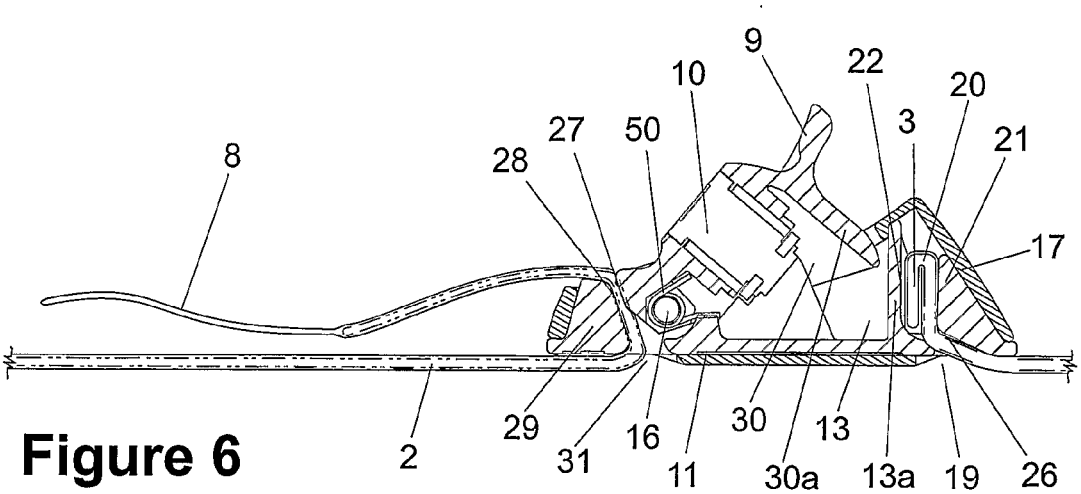
FIG. 6 shows a cross-sectional side elevational view of the tie down strap with a free end of the strap latched between clamp jaws of the buckle member.

FIG. 6 shows a cross-sectional view through a lockable tie down strap according to the invention.

As shown, the latch member 9 is urged into a normally clamping engagement with body member 11 by means of a spring member 50 mounted on latch pivot pin 16 and coacting between latch member 9 and body 11. With flexible strap member 2 under tension, jaw surfaces 27,28 are drawn into a self-clamping state by frictional engagement with strap member 2. With the free end portion 8 of strap member 2 passing over the front portion 29 of body 11, a mechanical advantage is obtained by drawing the free end portion 8 back over strap member 2 to tension strap member 2.

Figure 7:
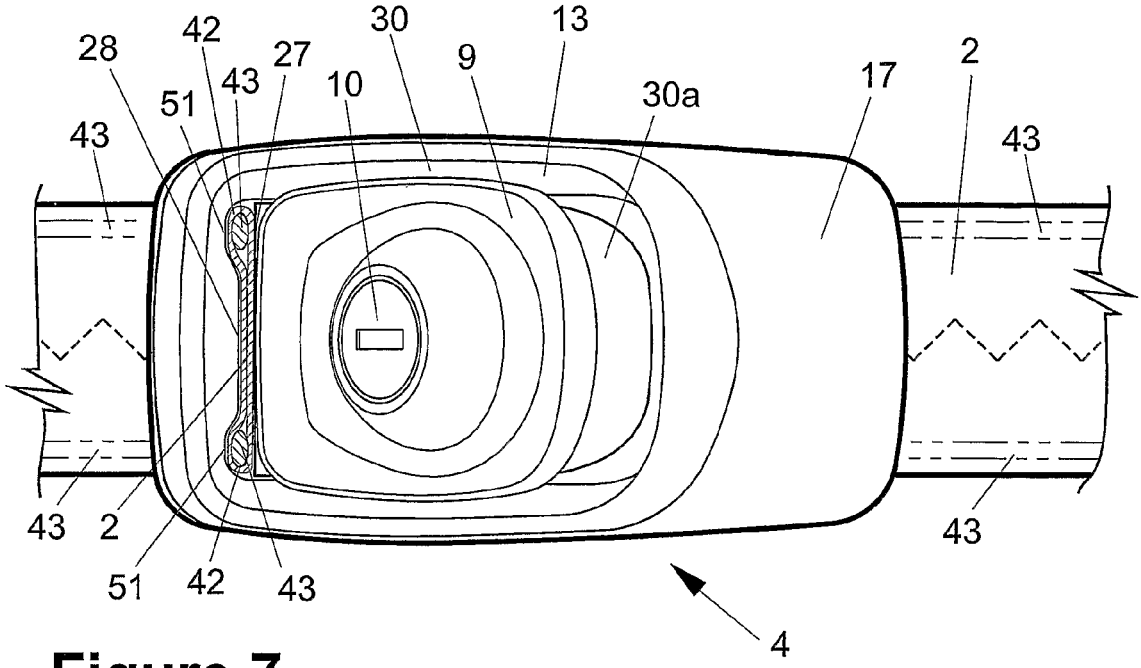
FIG. 7 shows a partial top plan view of an alternative embodiment of a reinforced strap member in a clamped state.
Figure 8:
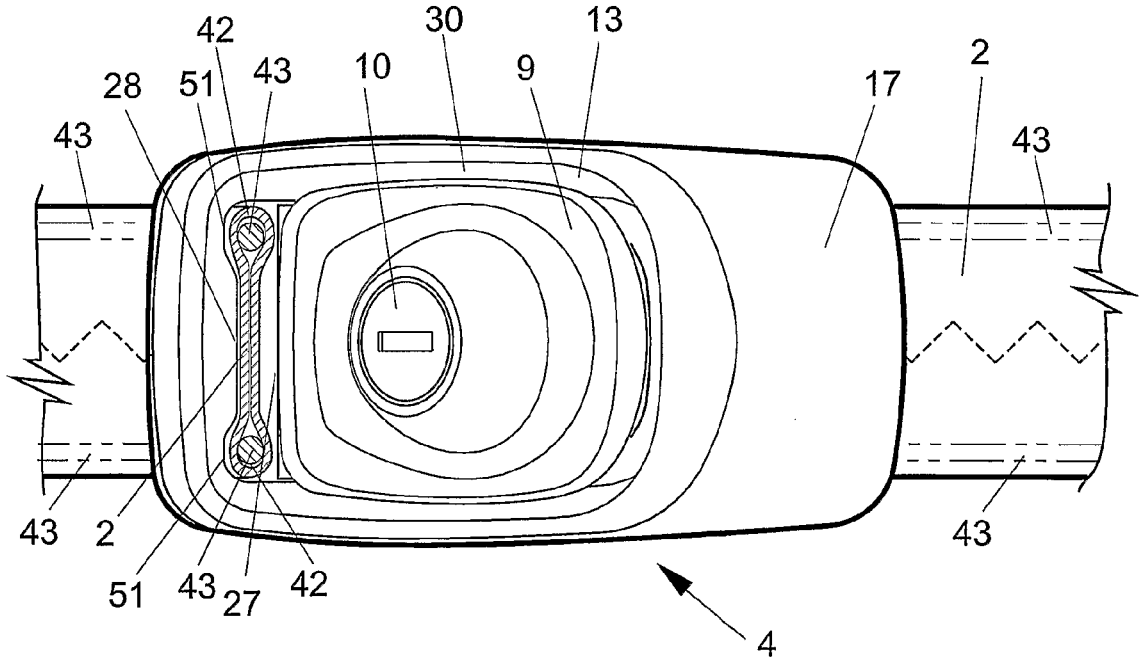
FIG. 8 shows the partial top view of FIG. 7 with the strap member in an unclamped state.

FIGS. 7 and 8 illustrate an alternative embodiment of the invention in a clamped and unclamped state respectively.

As reinforcing cables 43 cause a local thickening in the transverse width of strap 2, a contoured shape is formed on jaw surface 28 to form channel-like recesses 51 in the region of the cables 43 when the strap member 2 passes between clamping jaw surfaces 27, 28.

In FIG. 7, the jaws provide a substantially even compressive force across the full width of the cable reinforced strap member 2 with both the outer pocket regions 42 containing cables 43 being clamped with substantially the same compressive force as the unreinforced strap region therebetween. In this embodiment, jaw surface 28 is formed as a smooth surface without toothed projections to enable the strap member to be easily tensioned without causing unnecessary wear thereon.

Figure 9:
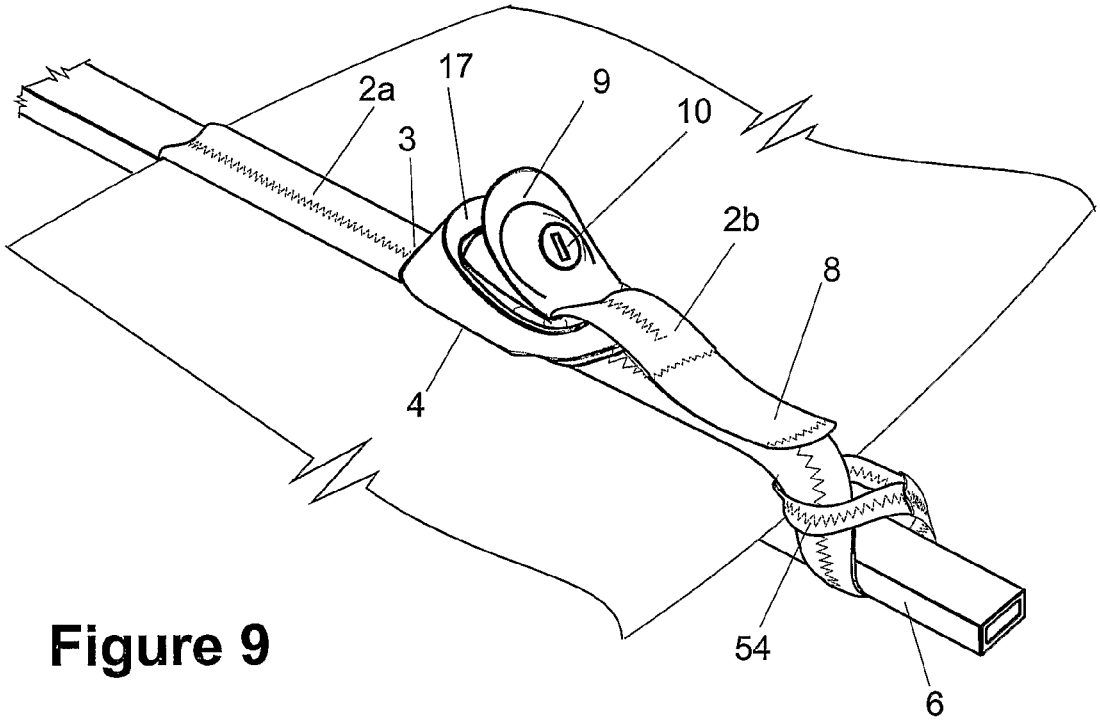
FIG. 9 shows an alternative embodiment of the invention securing a surfboard to a cross-bar of a vehicular roof rack.
Figure 10:
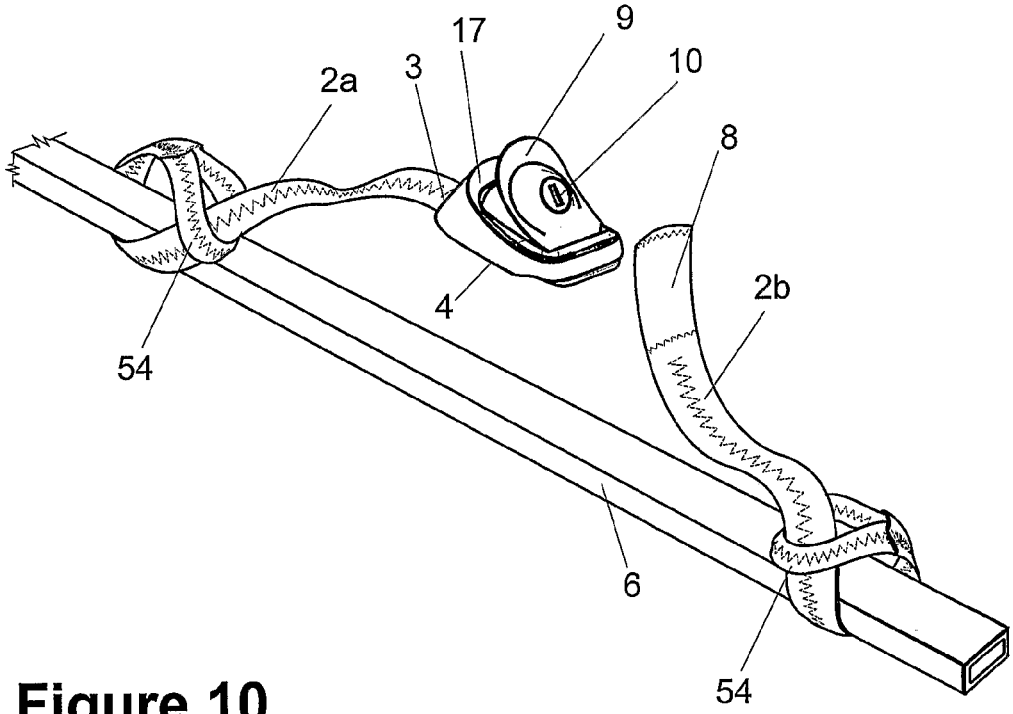
FIG. 10 shows the embodiment of FIG. 9 in a disconnected state.

FIGS. 9 and 10 show yet another embodiment of the invention.

In the embodiment shown, strap member 2 is formed as separate strap portions 2*a*, 2*b* each with a loop 54 formed on one end thereof. An opposite end 3 of strap member 2*a* is captively secured in buckle member 4 as illustrated in FIGS. 2, 3 and 6 while strap member 2*b* has an unreinforced free end portion 8 as shown in FIG. 5.

The embodiment of FIGS. 9 and 10 functions in a substantially identical manner to the embodiment of FIG. 1 except that frictional engagement of surfboard 7 is effected by the surface of cross-bar 6 and a single strap member 2. This embodiment enables the use of free end strap members 2*b* of varying lengths to suit surfboards, snow boards or the like devices of varying transverse dimensions.

From the foregoing description of various embodiments of the invention it will be apparent that the invention provides a simple, elegant and cost efficient lockable tie down strap which is easy to use and overcomes the problems of prior art devices of this kind.

It will be readily apparent to a person skilled in the art that many modifications and variations may be made to the invention without departing from the spirit and scope thereof.

For example, an undersurface of strap member 2 may be coated with a soft polymeric material which, when compressed against a surfboard, snow board or the like by tension in strap member 2, exhibits a very high coefficient of friction to resist theft of the surfboard, snow board or the like by attempting to slide it out from under the tensioned strap member 2. The soft polymeric material would also assist in retaining a secure slip free clamping engagement of strap member 2 between jaw surfaces 27,28 and also in reducing frictional wear on strap member 2 over time. The soft polymeric material may be formed as a contiguous layer or as a discontinuous pattern of shapes such as diagonal strips, circles or the like.

The invention claimed is:

1. A tensionable lockable tie down strap for securing a surfboard to a vehicle carry rack, said strap comprising:

at least one flexible strap member including at least one reinforcing element;

a buckle member comprising a body having an internal cavity in which is fixedly secured a captive end of said at least one flexible strap member inaccessibly within said body;

a latch member adapted to releasably engage a free end portion of said strap member, said latch member being movable between a strap release position and a strap securing position;

a lock mechanism to selectively secure said latch member in said strap securing position, said lock member being located in an inaccessible enclosure in said buckle member; and opposed jaw surfaces comprising a first jaw surface associated with said body and a second jaw surface associated with said latch member, said free end portion of said flexible strap member extending back around a load bearing member associated with said buckle to permit, in use, a mechanical advantage when a tensile force is applied to said free end portion of said strap member.

2. A tie down strap as claimed in claim 1 wherein said flexible strap member is substantially inextensible.

3. A tie down strap as claimed in claim 1 wherein said jaw surfaces, in use, are adapted to apply a substantially even compressive force across the width of said at least one flexible strap member secured therebetween.

4. A tie down strap as claimed in claim 1 wherein said opposed jaw surfaces are contoured to accommodate transverse variations in thickness in said strap member.

5. A tie down strap as claimed in claim 1 wherein said flexible strap member includes a plurality of reinforcing elements.

6. A tie down strap as claimed in claim 5 wherein said flexible strap member includes reinforcing elements located adjacent opposite edges thereof.

7. A tie down strap as claimed in claim 1 wherein said opposed jaw surfaces are self clamping when said flexible strap member is tensioned.

8. A tie down strap as claimed in claim 1 wherein at least one of said opposed jaw surfaces includes toothed projections.

9. A tie down strap as claimed in claim 1 wherein at least one of said opposed jaw members includes at least one smooth surface.

10. A tie down strap as claimed in claim 1 wherein said body includes a shroud member restricting access to one end of a flexible strap member captively secured within said body.

11. A tie down strap as claimed in claim 10 wherein said shroud member is removable from said body when said free end portion of said flexible strap member is disconnected from said body.

12. A tie down strap as claimed in claim 10 wherein said shroud member forms a protective cover extending over a base of said body.

13. A tie down strap as claimed in claim 1 wherein said latch member is pivotally mounted to said body.

14. A tie down strap as claimed in claim 1 wherein a pivotal axis of said latch member is located adjacent a jaw surface formed thereon to provide, in use, a mechanical advantage to disengage said jaw surfaces when in a self-clamping state.

15. A tie down strap as claimed in claim 1 wherein said lock mechanism is mounted in said latch member.

16. A tie down strap as claimed in claim 1 wherein said first jaw surface is formed on said load bearing member.

* * * * *